US008695162B2

(12) United States Patent
Yokote et al.

(10) Patent No.: US 8,695,162 B2
(45) Date of Patent: Apr. 15, 2014

(54) ELECTRIC BLOWER AND VACUUM CLEANER COMPRISING SAME

(75) Inventors: Shizuka Yokote, Osaka (JP); Michihiro Kurokawa, Osaka (JP); Akira Yamaguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/813,568

(22) PCT Filed: Feb. 15, 2012

(86) PCT No.: PCT/JP2012/000972

§ 371 (c)(1),
(2), (4) Date: Jan. 31, 2013

(87) PCT Pub. No.: WO2012/111318

PCT Pub. Date: Aug. 23, 2012

(65) Prior Publication Data

US 2013/0125339 A1 May 23, 2013

(30) Foreign Application Priority Data

Feb. 17, 2011 (JP) ..... 2011-031591

(51) Int. Cl.
*A47L 9/22* (2006.01)
*F04D 29/44* (2006.01)

(52) U.S. Cl.
USPC ..... 15/412; 415/206; 415/224; 415/224.5; 415/225; 415/226

(58) Field of Classification Search
USPC ..... 15/300.1, 412; 415/211.2, 224, 224.5, 415/225, 226, 203, 206
IPC ..... A47L 9/22; F04D 29/44
See application file for complete search history.

(56) References Cited

U.S. PATENT DOCUMENTS

2011/0277267 A1 11/2011 Nakamura et al.

FOREIGN PATENT DOCUMENTS

| | | | |
|---|---|---|---|
| JP | 61-040495 | A | 2/1986 |
| JP | 2000-337295 | A | 12/2000 |
| JP | 2002-115698 | A | 4/2002 |
| JP | 2004-068723 | A | 3/2004 |
| JP | 2005-220853 | A | 8/2005 |
| JP | 2005-226608 | A | 8/2005 |
| JP | 2007-182852 | A | 7/2007 |
| JP | 2010-216364 | A | 9/2010 |
| WO | WO 2010/090006 | A1 | 8/2010 |

OTHER PUBLICATIONS

International Search Report for International Application No. PCT/JP2012/000972, dated May 22, 2012, 2 pages.
Supplementary European Search Report in corresponding European Application No. 12 74 7867, dated Jul. 1, 2013, 6 pages.

*Primary Examiner* — David Redding
(74) *Attorney, Agent, or Firm* — Brinks Gilson & Lione

(57) ABSTRACT

Disclosed is an electric blower having a stator, a rotor, a bracket, a rotary fan, an air guide and a fan case. The air guide comprises a partition plate, a diffuser disposed around outer periphery of the rotary fan in the air guide, a partition-plate sloped portion and a guide vane. The fan case has a fan-facing portion, a fan case shoulder bent at the outermost part of the fan-facing portion, and a cylindrical portion extending cylindrically in an axial direction from the fan case shoulder. The fan case shoulder is so bent that it forms substantially a right angle.

4 Claims, 10 Drawing Sheets

50

ELECTRIC BLOWER AND VACUUM CLEANER COMPRISING SAME

This application is a 371 application of PCT/JP2012/000972 having an international filing date of Feb. 15, 2012, which claims priority to JP2011-031591 filed Feb. 17, 2011, the entire contents of which are incorporated herein by reference.

TECHNICAL FIELD

The present invention relates to an electric blower and an electric vacuum cleaner equipped with the same.

BACKGROUND ART

Countless studies have hitherto been made in the efforts of reducing noise of electric blowers for use in vacuum cleaners and the like apparatuses. One example of such electric blowers is to generate an air output by converting a dynamic pressure obtained by centrifugal force of rotary fan 105 into a static pressure with an air guide.

FIG. 10 is a sectional view illustrating a conventional electric blower. Electric blower 150 shown in FIG. 10 comprises stator 101 and rotor 102 mounted on bracket 103 as an electric motor. Rotor 102 has rotary fan 105 mounted to one end of output shaft 104 that projects from bracket 103. There is air guide 106 disposed as a partition for separating between rotary fan 105 and the electric motor. Rotary fan 105 mounted to output shaft 104 is rotated to produce a flow of suctioned air from opening 105*b* when the electric motor is driven. This airflow is deflected to a radial direction 90 degrees from an axial direction, and flows outward in the radial direction while gaining a dynamic pressure given by fan blades 105*d* of rotary fan 105. The airflow delivered from rotary fan 105 is decelerated as it passes through an airflow path composed of diffuser 106*a* of air guide 106 disposed around the outer periphery of rotary fan 105, and converted from the dynamic pressure into a static pressure. After having passed through diffuser 106*a*, the airflow is forced to change its direction for 180 degrees in the way to pass through return path 109*b* composed of the outer periphery of air guide 106 and cylindrical portion 108*d* of fan case 108. The airflow is further guided into the electric motor by guide vane 106*b* of air guide 106 through partition plate 106*c*, and blown to the outside while cooling the electric motor.

Fan case 108 has a shape as shown in FIG. 10, which comprises fan-facing portion 108*c*, fan case shoulder 108*b* and cylindrical portion 108*d*. Fan-facing portion 108*c* is formed to face rotary fan 105 and extend radially about air inlet opening 108*a*. Fan case shoulder 108*b* is curved from the outermost part of fan-facing portion 108*c* to become parallel with output shaft 104, and cylindrical portion 108*d* extends cylindrically in parallel with output shaft 104 from fan case shoulder 108*b*. Fan case shoulder 108*b* is provided with a fillet of large circular arc formed to make the airflow turn around for 180 degrees after it passes diffuser 106*a*. Here, the fillet refers to a rounded shape so processed by joining two surfaces with another piece having an arc shape in cross section. In addition, a corner at an exit side in the airflow path of diffuser 106*a* is also cut to form an arc shape in a manner to conform to fan case shoulder 108*b*, and designated as diffuser shoulder 106*e*.

FIG. 11 is a drawing that schematically illustrates shapes of fan case shoulder 108*b* and diffuser shoulder 106*e* of the conventional electric blower. In FIG. 11, the shapes of fan case shoulder 108*b* and diffuser shoulder 106*e* are depicted in their meridian plane. In other words, FIG. 11 represents a sectional view of fan case shoulder 108*b* and diffuser shoulder 106*e* as they are cut with a plane containing output shaft 104, and that this sectional view includes a revolved projection of diffuser shoulder 106*e*. As shown in FIG. 11, both fan case shoulder 108*b* and diffuser shoulder 106*e* of the conventional structure have circular arc fillets formed to have radius R. These conventional fan case shoulder 108*b* and diffuser shoulder 106*e* have circular arc to radius ratios of the same value.

As a method of designing an electric blower of this type, an inner diameter, an outer diameter, an inlet opening height and an outlet opening height of each of the rotary fan and the air guide are determined according to working points such as a flow rate, a pressure and a rotating speed of an electric apparatus for which the electric blower is used. In addition to these factors essential for the designing, it is also necessary to form an airflow path of the shape capable of reducing abrupt changes in the pressure and flow velocity in order to achieve noise reduction of the electric blower. This is for the purpose of making it capable of suppressing development of turbulent airflow. There are other measures taken for this purpose such as an improvement in the shapes of individual parts of the air guide in addition to designing the shape of fan blades (refer to patent literatures 1 and 2, for example), an idea of reducing changes in the pressure that occur when trailing edges of the rotary fan blades cross a leading edge of the diffuser by increasing a distance between the trailing edges of the rotary fan blades and the leading edge of the diffuser, decreasing a rotating speed of the rotary fan, and so on.

The method discussed above to increase the distance between the trailing edges of the rotary fan blades and the leading edge of the diffuser gives rise to a drawback, however, that it increases a loss attributable to increase in slippage and back-flow of the air at the trailing edges. In addition, the efficiency of blowing air also decreases due to a decrease in the dynamic pressure when the rotating speed of the electric blower is reduced.

There are also other means to achieve noise reduction by disposing a soundproofing material, a noise attenuation mechanism, and the like in a main body of an apparatus such as vacuum cleaner. However, these means also reduce a suctioning power of the vacuum cleaner and worsen the operability since they lead to an increase in pressure loss inside the airflow path as well as an increase in weight of the main body of the apparatus.

PTL 1: Unexamined Japanese Patent Publication No. 1986-40495

PTL 2: Unexamined Japanese Patent Publication No. 2005-220853

SUMMARY OF THE INVENTION

The present invention is to provide electric apparatuses that are capable of reducing noise without decreasing output power of blowers.

An electric blower of the present invention comprises a stator, a rotor supported inside the stator in a rotatable manner around an output shaft, a bracket supporting the stator, a rotary fan mounted to one end of the output shaft in an axial direction thereof, an air guide disposed between the bracket and the rotary fan, and a fan case having an air inlet opening at a center of the fan case and covering the air guide and the rotary fan. The air guide comprises a partition plate disposed between the bracket and the rotary fan, a diffuser provided with a plurality of diffuser vanes and disposed around the outer periphery of the rotary fan, a partition-plate sloped portion having a slope and in contact with a bottom surface of the diffuser, and a guide vane formed on the back side of the diffuser through the partition plate. The fan case comprises a fan-facing portion extending radially and facing the rotary fan, a fan case shoulder bent at an outermost part of the fan-facing portion toward the axial direction, and a cylindrical portion extending cylindrically in the axial direction from the fan case shoulder. The fan case shoulder is so bent that it forms substantially a right angle.

Another electric blower of the present invention comprises a stator, a rotor supported inside the stator in a rotatable manner around an output shaft, a bracket supporting the stator, a rotary fan mounted to one end of the output shaft in an axial direction thereof, an air guide disposed between the bracket and the rotary fan, and a fan case having an air inlet opening at a center of the fan case and covering the air guide and the rotary fan. The air guide comprises a partition plate disposed between the bracket and the rotary fan, a diffuser provided with a plurality of diffuser vanes and disposed around the outer periphery of the rotary fan, a partition-plate sloped portion having a slope and in contact with a bottom surface of the diffuser, and a guide vane formed on the back side of the diffuser through the partition plate. The fan case comprises a fan-facing portion extending radially and facing the rotary fan, a fan case shoulder curved into an arc shape from an outermost part of the fan-facing portion toward the axial direction, and a cylindrical portion extending cylindrically in the axial direction from the shoulder. The diffuser vane has a diffuser shoulder cut into a circular arc shape at one corner adjacent to an exit side in an airflow path of the diffuser. The fan case shoulder and the diffuser shoulder are so composed that a circular arc radius of the fan case shoulder is one-half of or smaller than one-half of a circular arc radius of the diffuser shoulder in their meridian plane.

It becomes possible by virtue of the above structure that swirling air generated around the diffuser flows steadily in the airflow path composed of a space from the diffuser's trailing edge to the fan case shoulder. It can hence suppress turbulent airflow, reduce fluctuations in pressure and decrease noise of the electric blower.

A vacuum cleaner of the present invention comprises any of the electric blowers discussed above.

It is by virtue of the above structures that can decrease operating noise of the vacuum cleaner while maintaining a strong suctioning force without increasing the size and weight of the main body.

Accordingly, the electric blower of the present invention is capable of decreasing noise without decreasing the output power of the blower, and it can hence achieve noise reduction of the apparatus equipped with the blower.

DETAILED DESCRIPTION OF THE PREFERRED EMBODIMENTS

Description is provided hereinafter of exemplary embodiments of the present invention with reference to the accompanying drawings.

First Exemplary Embodiment

Described now pertains to electric blower 50 for use in an electric apparatus according to the first embodiment of this invention.

Figure 1:
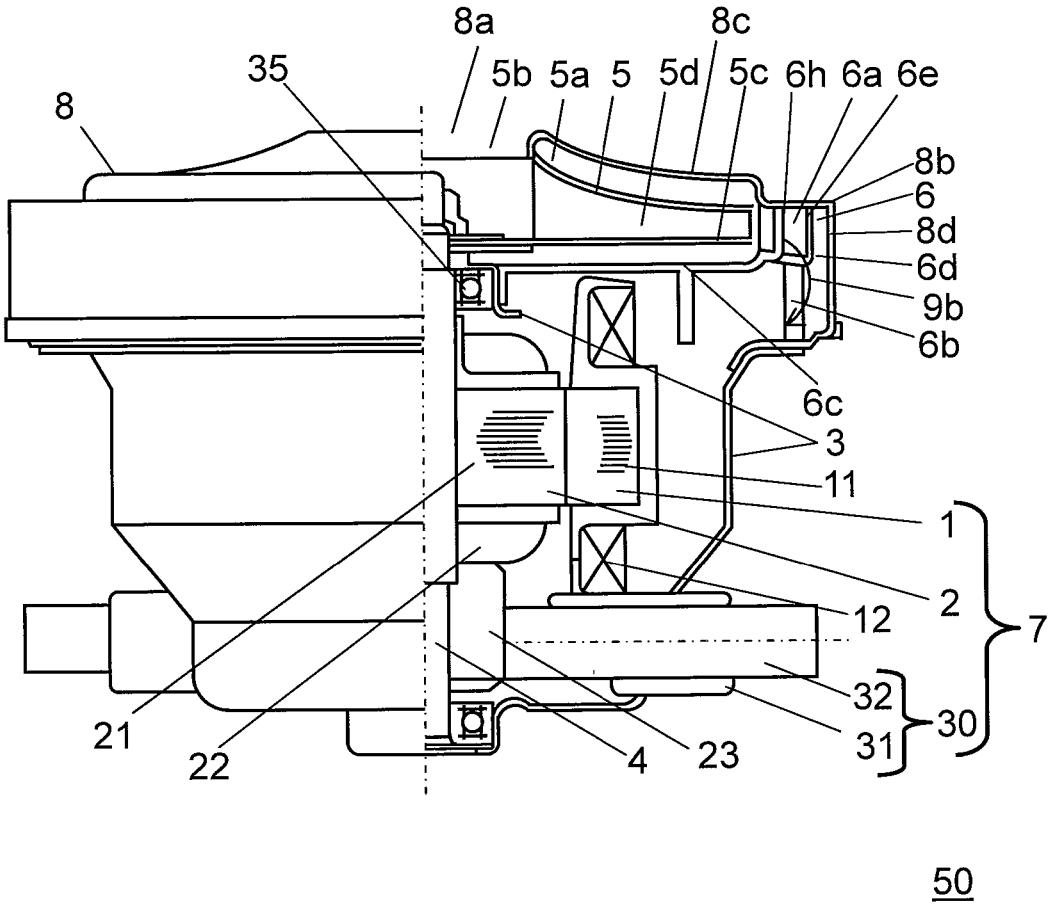
FIG. 1 is a sectional view of an electric blower according to a first exemplary embodiment of the present invention.

FIG. 1 is a sectional view of electric blower 50 according to the first embodiment of this invention.

Electric blower 50 comprises electric motor 7, bracket 3, rotary fan 5, air guide 6 and fan case 8. Electric motor 7 further comprises stator 1, rotor 2 and brush unit 30.

In electric motor 7, stator 1 is formed of field winding 12 wound around field core 11.

Rotor 2 comprises armature core 21, armature winding 22, commutator 23 and output shaft 4. Armature winding 22 is partially connected to commutator 23. Armature core 21 includes armature winding 22 wound around it. This commutator 23 and armature core 21 are coupled to output shaft 4. Rotor 2 of such a structure is disposed and supported inside stator 1 in a manner to be rotatable around output shaft 4.

Stator 1 is fixed inside bracket 3. Bracket 3 is also provided with brush holder 31 fixed to it. Brush holder 31 retains a pair of carbon brushes 32 in it, and the pair of carbon brushes 32 stay in contact with commutator 23.

Brush unit 30 comprises carbon brushes 32 and brush holder 31 of such structure.

Output shaft 4 extends axially, or the longitudinal direction thereof and one end of output shaft 4 projects from the upper side of bracket 3. Both ends of output shaft 4 are supported by their corresponding bearings 35 so as to make output shaft 4 freely rotatable.

Rotary fan 5 is mounted to the end of output shaft 4 that projects from bracket 3. Air guide 6 is placed to form an airflow path around the outer periphery of rotary fan 5.

Rotary fan 5 comprises side plate 5*a*, main shroud 5*c* and fan blades 5*d* fixed between side plate 5*a* and main shroud 5*c*. Rotary fan 5 has the plurality of fan blades 5*d* so positioned on main shroud 5*c* that the individual fan blades 5*d* form scroll patterns at regular intervals. In addition, rotary fan 5 has opening 5*b* formed in the center part of side plate 5*a* for suctioning air.

There is air guide 6 so placed that it forms the airflow path around the outer periphery of rotary fan 5, and fan case 8 is mounted to cover an open side of bracket 3. Fan case 8 has air inlet opening 8*a* in the center part thereof, and it is disposed in a manner to cover air guide 6 and rotary fan 5.

Fan case 8 has a shape comprised of fan-facing portion 8*c*, fan case shoulder 8*b* and cylindrical portion 8*d*. Fan-facing portion 8*c* is formed to face rotary fan 5 in the axial direction and extend radially into a circular shape around air inlet opening 8*a*. Fan case shoulder 8*b* is bent into the axial direction from the outermost part of fan-facing portion 8*c* toward electric motor 7. Cylindrical portion 8*d* extends cylindrically in the axial direction toward electric motor 7 from fan case shoulder 8*b*.

Air guide 6 has partition plate 6*c*, diffuser 6*a*, partition-plate sloped portion 6*d* and guide vane 6*b*.

Partition-plate sloped portion 6*d* is so formed as to become sloped and in contact with a bottom surface of diffuser 6*a*. In other words, it is sloped from the inlet opening side to the outlet opening side in the direction of outer periphery of air guide 6.

In addition, fan case 8 is so formed that fan case shoulder 8*b* is bent to substantially a right angle according to this embodiment. More specifically, fan case 8 is made to have fan case shoulder 8*b* of generally a right-angled shape on its inner surface side, and this shape is formed to continue along the peripheral direction. Fan case shoulder 8*b* of the above shape provided in this embodiment is to secure a sufficient space between the outer periphery of diffuser 6*a* and fan case shoulder 8*b*, thereby achieving stabilization of the flow of swirling air in this space.

In electric blower 50 constructed as above, an armature current flows through armature winding 22 by way of carbon brushes 32 and commutator 23 when an electric power is supplied from an external power supply to electric motor 7. In addition, a field current flows through field winding 12 of stator 1. There is thus a force generated between a magnetic flux produced in field core 11 by the field current and the armature current that flow in armature winding 22, and output shaft 4 starts rotating as a result.

Rotary fan 5 fixed to output shaft 4 with a nut or the like means also rotates along with rotation of output shaft 4. The rotation of rotary fan 5 increases a flow velocity of air in rotary fan 5, and produces a flow of the air suctioned through opening 5*b* provided in side plate 5*a*. This airflow is turned into the radial direction about 90 degrees from the axial direction, and flows outward in the radial direction while gaining a dynamic pressure given by fan blades 5*d*. The air delivered from rotary fan 5 is led to air guide 6 provided around the outer periphery of rotary fan 5, and this airflow is decelerated as it passes through closed flow-paths formed in diffuser 6*a* at the front side of air guide 6.

Diffuser 6*a* comprises a plurality of diffuser vanes, and the closed flow-paths are formed between diffuser vanes. Accordingly, air guide 6 converts the dynamic pressure of the suctioned air into a static pressure.

After having passed through the closed flow-paths, the airflow is forced to change its direction for 180 degrees in the way to pass through return path 9*b* composed of the outer periphery of air guide 6 and an inner surface of fan case 8. There is a rounded corner (R) of radially arc shape, designated as diffuser shoulder 6*e*, formed along the edge at the exit side of the closed flow-paths of diffuser 6*a* to make the airflow change its direction efficiently. The airflow, the direction of which has been changed, is guided into electric motor 7 by guide vane 6*b* disposed on the backside of air guide 6 through partition plate 6*c*. The airflow is then blown out while cooling electric motor 7.

Figure 2:
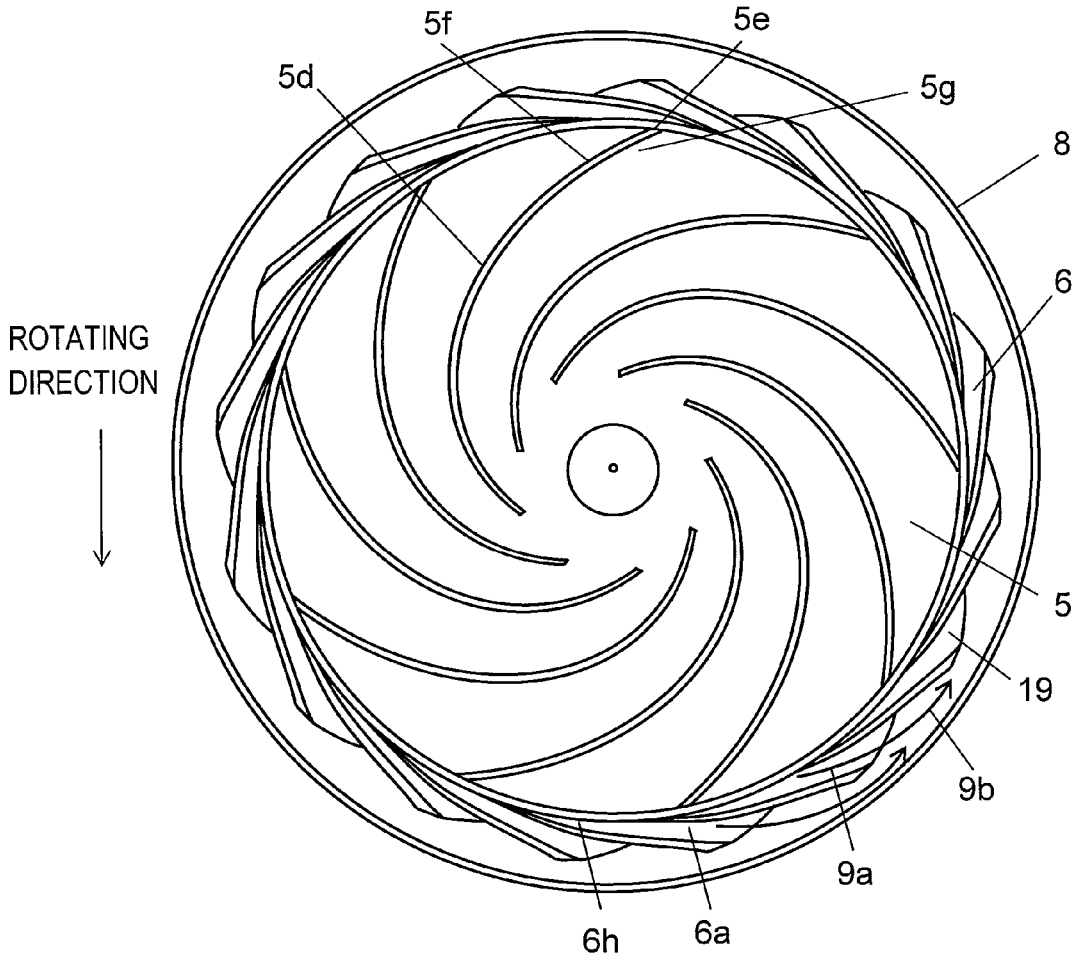
FIG. 2 is a top view of a rotary fan and an air guide.

FIG. 2 is a top view of rotary fan 5 and air guide 6.

Rotary fan 5 rotates in the direction of arrow shown in FIG. 2. Acting surfaces 5*f* of fan blades 5*d* receive a high pressure as rotary fan 5 rotates, since acting surfaces 5*f* carry out a heavy work effecting on the fluid. On the other hand, suction surfaces 5*g* of fan blades 5*d* receive a pressure lower than that of acting surfaces 5*f* because suction surfaces 5*g* carry out a light work upon the fluid. For this reason, a pressure inside closed flow-paths 19 rises when acting surfaces 5*f* are in positions facing flow-path inlets 6*h* of diffuser 6*a* whereas the pressure in closed flow-paths 19 decrease when suction surfaces 5*g* are in positions facing flow-path inlets 6*h*. As a result, a rate of change in the pressure of closed flow-paths 19 with rotation of rotary fan 5 becomes the largest when trailing edges 5*e* of rotary fan 5 pass by flow-path inlets 6*h*. Therefore, the pressure in air guide 6 present in the coordinate system at rest changes as many times as a number of fan blades 5*d* per each rotation of rotary fan 5.

Such changes in the pressure at trailing edges 5*e* of rotary fan 5 become the largest cause of the noise coming out from electric blower 50.

The flow of the air released from trailing edges 5*e* of rotary fan 5 passes through individual diffuser paths 9*a*, and each of the airflow is combined in return path 9*b* with other airflows from adjoining diffuser paths 9*a*. The fluid of an amount corresponding to a load point out of this airflow goes out from return path 9*b* and flows toward electric motor 7 (in FIG. 1) via guide vane 6*b* (in FIG. 1). The other part of the fluid revolves around the outer periphery of diffuser 6*a* as a flow of swirling air. The efficiency of the blower decreases with movement of the fluid. In this case, they are losses in friction between the fluid and solid members, and a loss in pressure that occurs due to shearing of the fluid. The pressure loss increases if there is large turbulence in the airflow.

Figure 3A:
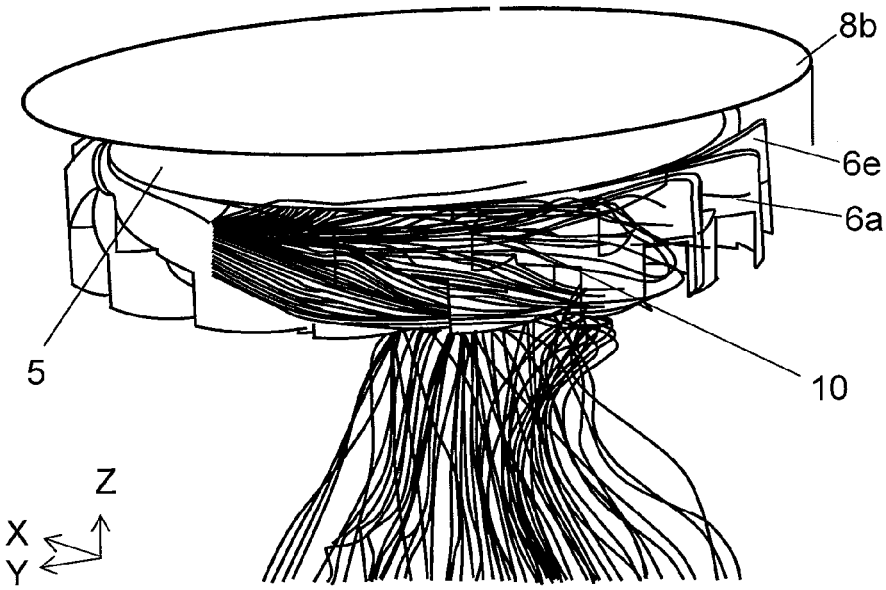
FIG. 3A is a streamline diagram taken by flow analysis of a fluid that passes through the rotary fan and a diffuser according to the first exemplary embodiment.
Figure 3B:
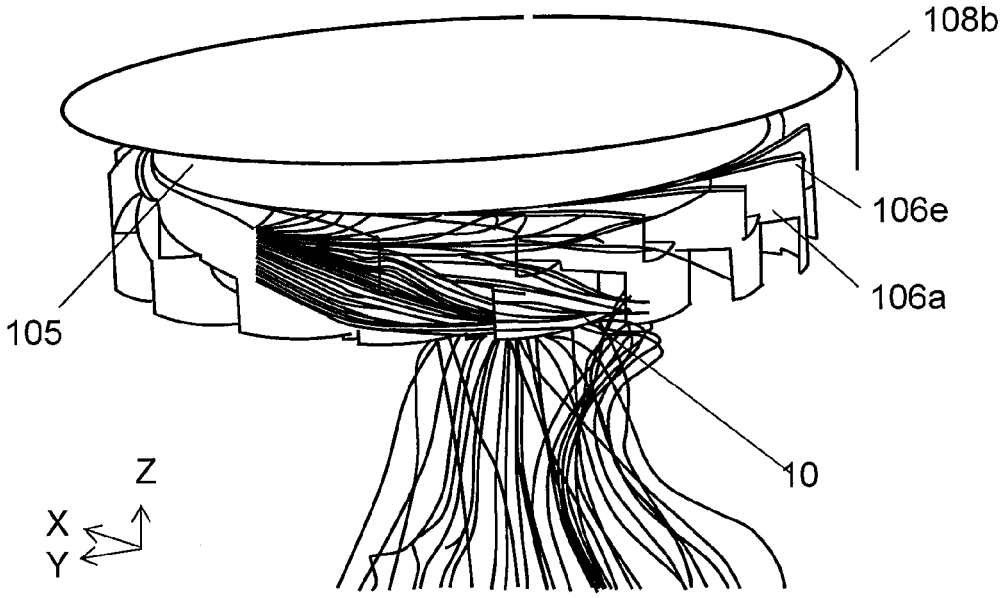
FIG. 3B is another streamline diagram taken by the flow analysis of a fluid that passes through a rotary fan and a diffuser of a control example.

FIG. 3A is a streamline diagram taken by flow analysis of the fluid that passes through rotary fan 5 and diffuser 6*a* according to the first embodiment, and FIG. 3B is another streamline diagram taken by the flow analysis of a fluid that passes through rotary fan 105 and diffuser 106*a* of a control example. The streamline diagram of FIG. 3B is that taken on an electric blower of the structure shown in FIG. 10 as a representative of the control example.

Figure 10:
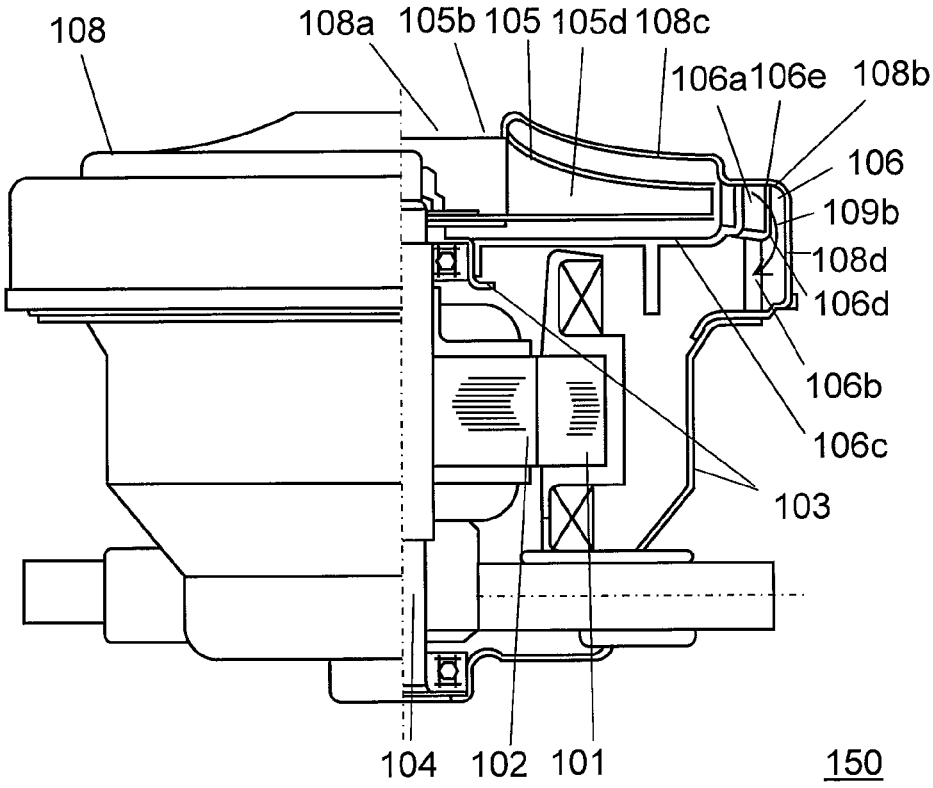
FIG. 10 is a sectional view showing a conventional electric blower.
Figure 11:
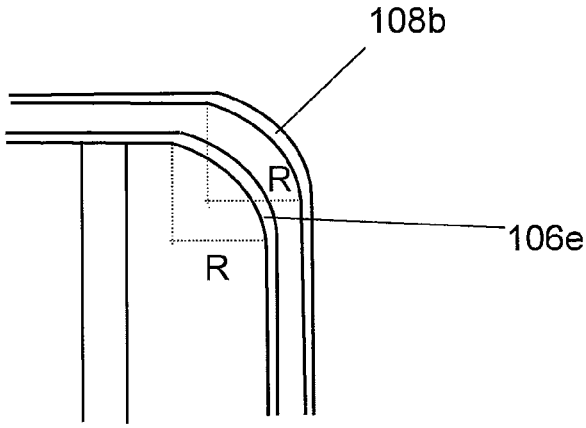
FIG. 11 is a drawing that schematically illustrates shapes of a fan case shoulder and a diffuser shoulder of a conventional electric blower.

The analysis in FIG. 3A was performed on fan case shoulder 8*b* of right-angled shape shown in FIG. 1, and the analysis in FIG. 3B was performed on fan case shoulder 108*b* of circular arc shape shown in FIG. 10. Both of diffuser shoulder 6*e* of the present invention and diffuser shoulder 106*e* of the control example are rounded (cut) into circular arc shapes in their meridian plane.

Description is provided here about the noise that occurs due to the flow of swirling air 10 by comparing FIG. 3A and FIG. 3B.

The flow of the air released from diffuser 6*a* is deflected into various directions upon hitting against fan case shoulder 8*b*. This causes turbulence in the flow of swirling air 10.

In the case of the structure of the control example, there appears turbulence in portions of swirling air 10 represented by the streamlines as shown in the streamline diagram of FIG. 3B. This is considered to be attributable to the fact that the space provided from the outer periphery of diffuser 106*a* to fan case shoulder 108*b* is narrow. In other words, the control example has a large arc shape formed in fan case shoulder 108*b*, and this is the reason that reduces the space from the outer periphery of diffuser 106*a* to fan case shoulder 108*b*. It is therefore considered that the flow of the air released from diffuser 106*a* is deflected into various directions upon hitting against fan case shoulder 108*b*, and causes turbulence in the flow of swirling air 10.

On the other hand, in the case of using fan case 8 of the present invention shown in FIG. 3A, a sufficient space is provided between the outer periphery of diffuser 6*a* and fan case shoulder 8*b* because fan case shoulder 8*b* has the shape formed into right angle. This allows swirling air 10 to flow steadily in this space. As a result, changes in the pressure are reduced around the exit area of diffuser 6*a*, thereby reducing the noise.

Description is provided next of a combination of fan case shoulder 8*b* and diffuser shoulder 6*e* of air guide 6 by referring to the drawings.

Here, fan case shoulder 8*b* of the present invention is right-angled and diffuser shoulder 6*e* is arc-shaped, as stated above. For the purpose of comparison with the present invention, the analysis has also been made on electric blowers designated as control examples 1 and 2. The control example 1 is provided with fan case shoulder 108*b* and diffuser shoulder 106*e* of arc shapes as shown in the structure of FIG. 10. The control example 2 has a structure comprising a right-angled fan case shoulder and a diffuser shoulder not having a rounded corner like those provided in the present invention and control example 1.

Figure 4A:
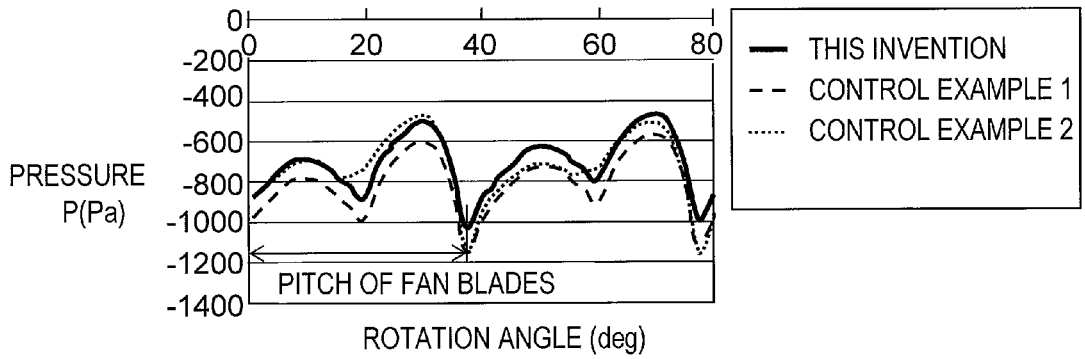
FIG. 4A is a graphic representation of pressure waveform of the fluid that passes through the fan case and the diffuser.

FIG. 4A is a graphic representation of pressure waveform of the fluid that passes through the fan case and the diffuser. FIG. 4A shows a result of calculation of the pressure waveforms made by the flow analysis on the three types, i.e., the present invention, control example 1 and control example 2, and it shows the changes in pressure (Pa) with respect to rotation angle (deg).

Figure 4B:
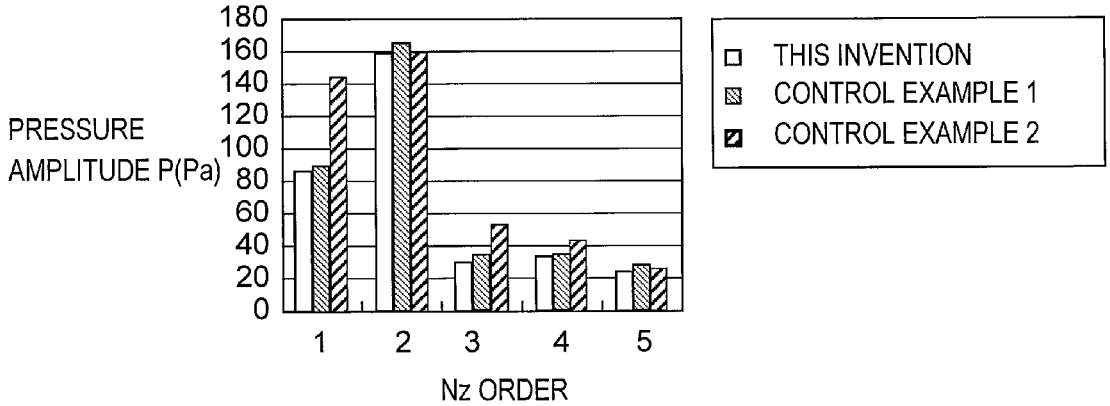
FIG. 4B is a graphic representation of pressure amplitude of the fluid that passes through the fan case and the diffuser.

FIG. 4B is a graphic representation of pressure amplitude of the fluid that passes through the fan case and the diffuser. FIG. 4B shows a result of calculation of the pressure amplitudes made by the flow analysis on the above three types. In FIG. 4B, vertical axis represents the pressure amplitude, and horizontal axis represents the fundamental wave denoted as 1 Nz order and harmonic components of its integer multiples denoted as 2 Nz, 3 Nz and the like orders, so that it indicates pressure amplitudes of the individual orders of harmonics of the waveform shown in FIG. 4A.

In the case of control example 1, there is a narrow space between the diffuser and the fan case shoulder because both fan case shoulder 108*b* and diffuser shoulder 106*e* are arc-shaped, as discussed above. This is considered to be the reason that the change in the pressure becomes so large as shown in FIG. 4A and FIG. 4B since it impedes the flow of swirling air 10.

In control example 2, the space between the diffuser and the fan case shoulder is also narrow because the diffuser shoulder is not cut off. This impedes the flow of swirling air 10, and the change in the pressure becomes quite large as shown in FIG. 4A because swirling air 10 begins to oscillate due to impediment by the diffuser shoulder. It is considered, as a result, that the matter becomes worsened than the structures of the present invention and control example 1 in view of noise reduction of the blower.

In contrast to such control examples 1 and 2, fan case shoulder 8*b* of this embodiment is right-angled and diffuser shoulder 6*e* arc-shaped to secure a sufficient space between diffuser 6*a* and fan case shoulder 8*b* so as not to impede with the flow of swirling air 10.

In this embodiment, diffuser shoulder 6*e* of diffuser 6*a* is cut and fan case shoulder 8*b* is formed into the right-angled shape as illustrated, to suppress the turbulence in the flow of swirling air 10, thereby reducing the noise without decreasing the output.

Although what has been described above is an example, in which fan case shoulder 8*b* of fan case 8 is formed into a right angle as such, it is also possible to form fan case shoulder 8*b* of the right-angled structure by other means of configuration.

Figure 5A:
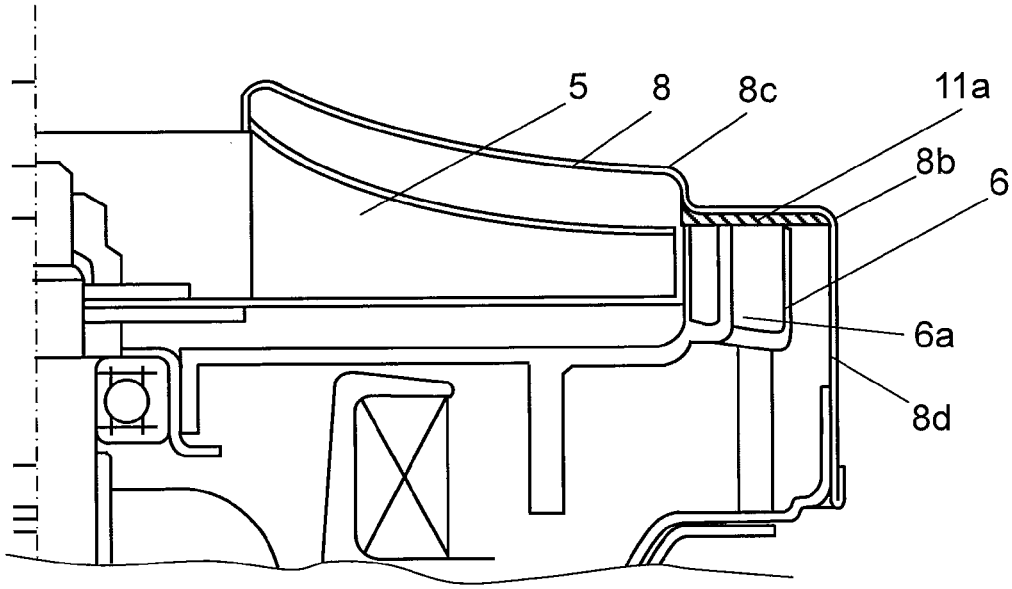
FIG. 5A is a sectional view of a modified example of the electric blower according to the first exemplary embodiment.
Figure 5B:
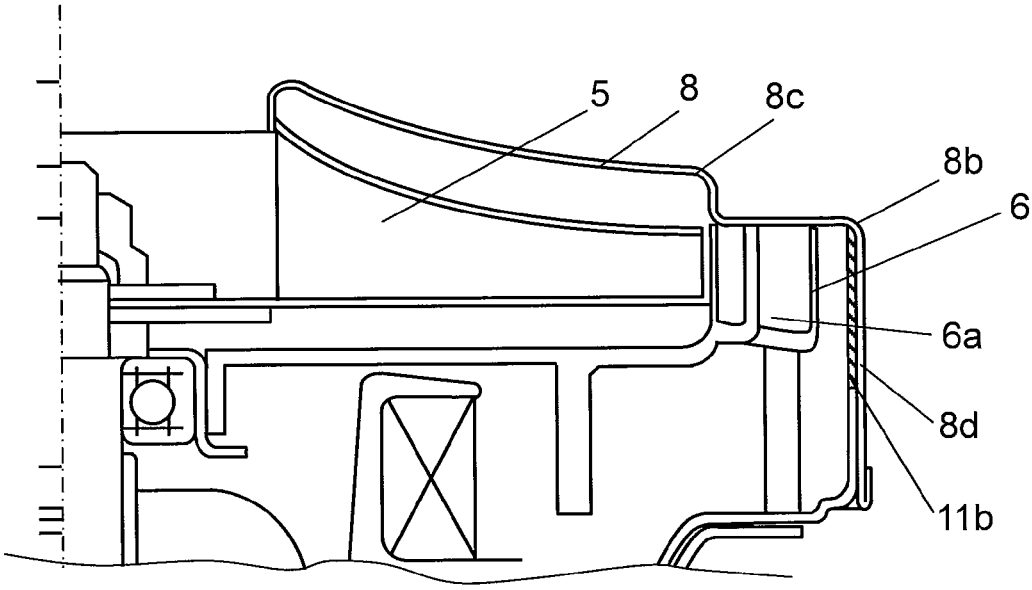
FIG. 5B is a sectional view of another modified example of the electric blower according to the first exemplary embodiment.

FIG. 5A is a sectional view of a modified example of electric blower 50 according to the first embodiment, and FIG. 5B is a sectional view of another modified example of electric blower 50 according to the first embodiment.

In FIG. 5A, square-forming part 11*a* is disposed between diffuser 6*a* and the outer periphery of fan-facing portion 8*c* of fan case 8. In another example of FIG. 5B, square-forming part 11*b* is disposed on the inside surface of cylindrical portion 8*d* of fan case 8. They have such structures, that square-forming part 11*a* or square-forming part 11*b* is disposed in a manner to abut on fan case shoulder 8*b* in order to form fan case shoulder 8*b* of the right-angled structure.

There arise some difficulties to compose the fan case shoulder of right angle since the fan case is fabricated normally with a sheet metal in many cases. It becomes possible with the use of any of square-forming part 11*a* and square-forming part 11*b* to make the fan case shoulder into a right angle.

As described above, the electric blower of the present invention comprises a stator, a rotor supported inside the stator in a rotatable manner around an output shaft, a bracket supporting the stator, a rotary fan mounted to one end of the output shaft in its axial direction, an air guide disposed between the bracket and the rotary fan, and a fan case having an air inlet opening at a center of the fan case and covering the air guide and the rotary fan. The air guide comprises a partition plate disposed between the bracket and the rotary fan, a diffuser provided with a plurality of diffuser vanes and disposed around the outer periphery of the rotary fan, a partition-plate sloped portion having a slope and in contact with a bottom surface of the diffuser, and a guide vane formed on the back side of the diffuser through the partition plate. The fan case comprises a fan-facing portion extending radially and facing the rotary fan, a fan case shoulder bent at an outermost part of the fan-facing portion toward the axial direction, and a cylindrical portion extending cylindrically in the axial direction from the fan case shoulder. The fan case shoulder is so bent that it forms substantially a right angle.

Since the diffuser shoulder is substantially right-angled, it increases a space between the diffuser and the fan case shoulder. This allows a swirling air to flow easily between the diffuser and the fan case. According to the present invention, the electric blower can reduce noise of the blower without decreasing an output thereof, thereby achieving noise reduction of an apparatus equipped with the blower.

Second Exemplary Embodiment

Description is provided hereinafter of the second embodiment by referring to the accompanying drawings. Like reference marks are used to designate like components as those of the first embodiment, and detailed explanation of them will be skipped. Fan case shoulder 8*b* of the second embodiment is formed into a circular arc shape, as compared with that of the first embodiment.

Figure 6A:
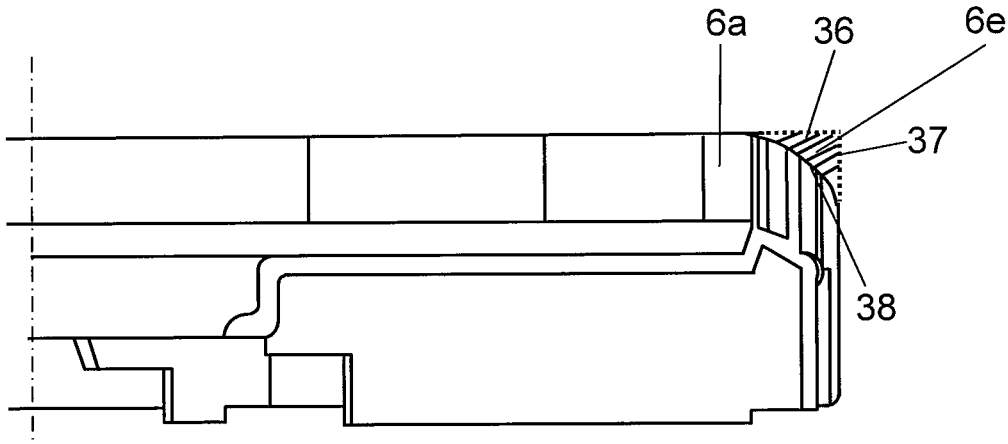
FIG. 6A is a sectional view of a diffuser according to a second exemplary embodiment.
Figure 6B:
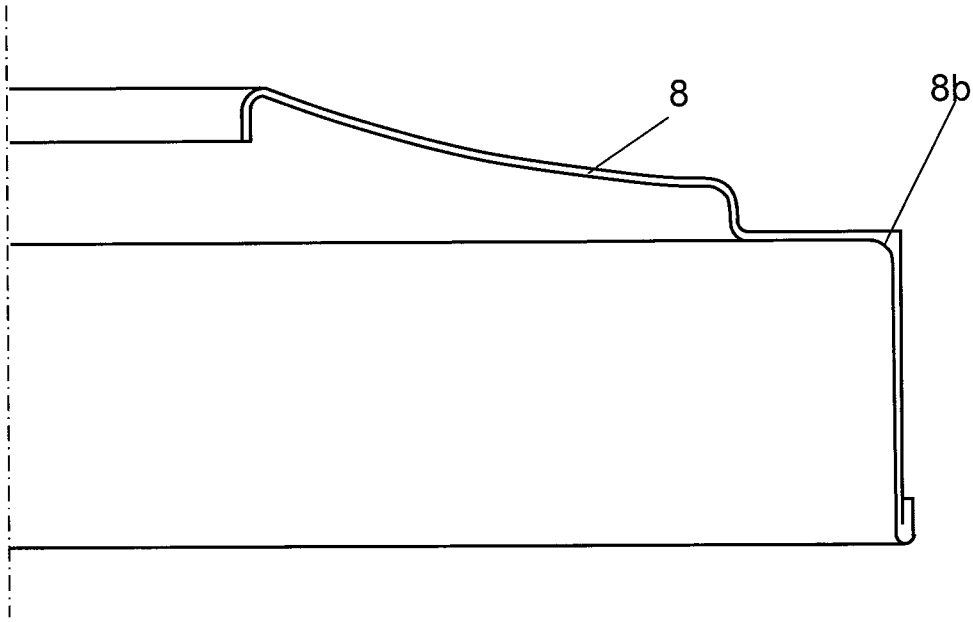
FIG. 6B is a sectional view of a fan case according to the second exemplary embodiment.

FIG. 6A is a sectional view of diffuser 6*a* according to the second embodiment. FIG. 6B is a sectional view of fan case 8 according to the second embodiment.

As shown in FIG. 6A, a portion of diffuser shoulder 6*e* of diffuser 6*a* shown by hatched lines is cut by means of cutting so that diffuser shoulder 6*a* is formed to have a circular arc shape in its meridian plane. In addition, fan case shoulder 8*b* of fan case 8 is formed to have a small circular arc shape in the meridian plane as shown in FIG. 6B. In other words, fan case shoulder 8*b* in this embodiment has a fillet formed in the circumferential direction.

Description is provided here about the noise that occurs in electric blower 50 constructed as above according to the second embodiment by referring to the accompanying drawing.

Figure 7:
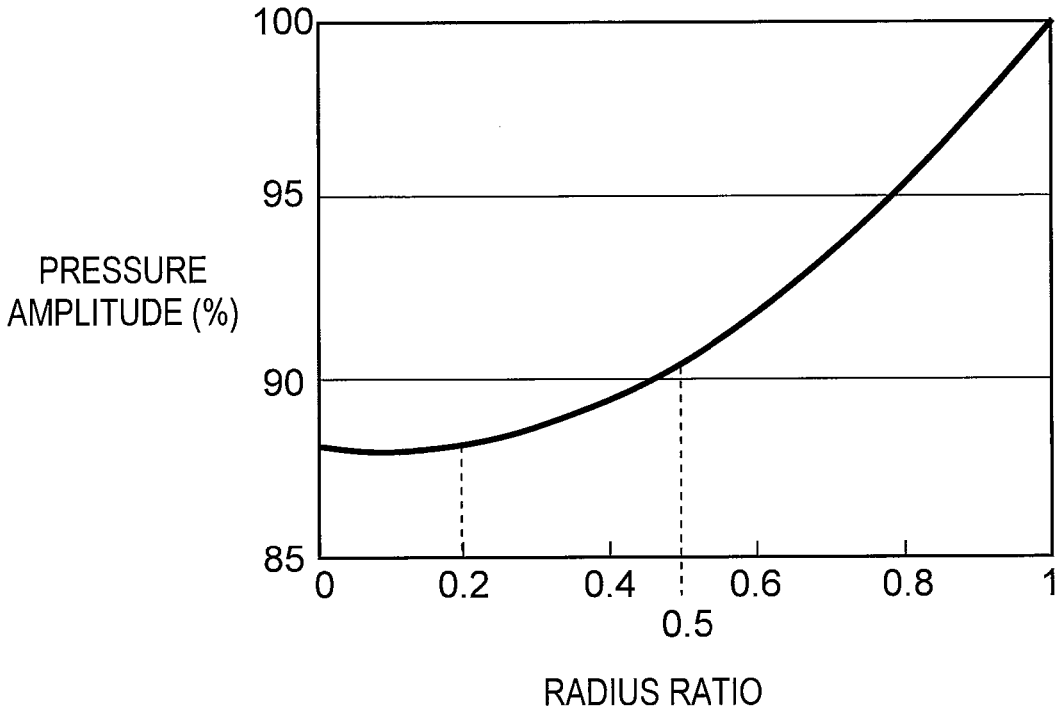
FIG. 7 is a graph showing changes in pressure around an exit of the diffuser relative to radius ratio of circular arcs between a diffuser shoulder and a fan case shoulder.

FIG. 7 is a graph showing changes in pressure around an exit of diffuser 6*a* relative to radius ratio of circular arc shapes between diffuser shoulder 6*e* and fan case shoulder 8*b*. FIG. 7 shows changes in pressure in the structures shown in FIG. 6A and FIG. 6B in which diffuser shoulder 6*e* is cut into the circular arc shape, and fan case shoulder 8*b* is cut into the arc shape.

The vertical axis of FIG. 7 represents change in pressure (i.e., amplitude of pressure waveform) in the vicinity of the exit of diffuser 6*a*, and the horizontal axis represents the ratio of radius dimension of circular arc of fan case shoulder 8*b* to radius dimension of circular arc of diffuser shoulder 6*e*. This means that fan case shoulder 8*b* is right-angled, for instance, when the radius ratio of circular arc is zero (0). The pressure amplitude of 100% in FIG. 7 represents a value obtained when a radius of the circular arc of diffuser shoulder 6*e* is equal to a radius of the circular arc of fan case shoulder 8*b*.

As shown in FIG. 7, the change in pressure decreases by about 10% when the radius ratio of the circular arc is reduced to 0.5 or less, or a ratio of cut-amount reduced to 0.25 or less, as compared to the case where the radius ratio of the circular arc is 1. This is the level that brings the intended effect of making low noise in an actual apparatus, thereby achieving noise reduction.

It is also obvious that the pressure amplitude remains generally same from 0 (i.e., right angle) to 0.2 in the radius ratio of circular arc, as shown in FIG. 7. This indicates that the effect of reducing the noise is generally the same. In other words, it is not necessary to make fan case shoulder 8*b* of a right angle as in the case of the first embodiment, but the noise can be reduced sufficiently even when it has a shape of circular arc to some degree.

As a result, a sufficient level of noise reduction can be achieved by setting the radius ratio of circular arc to 0.5 or smaller. In other words, it is appropriate to make the radius of the circular arc of fan case shoulder 8*b* one-half or smaller than that of diffuser shoulder 6*e*, when using the radius of diffuser shoulder 6*e* as the reference. Otherwise, the radius of the circular arc of diffuser shoulder 6*e* can be set to two times or larger than that of fan case shoulder 8*b* when using the radius of fan case shoulder 8*b* as a reference.

Although the above description is given on the bases of the radius ratio of circular arc, it may instead be substituted with a ratio based on areas cut off from fan case shoulder 8*b* and diffuser shoulder 6*e*. That is, an area in the meridian plane of a portion cut off to form the circular arc of fan case shoulder 8*b* can be set to one fourth or smaller than an area in the same meridian plane of a portion cut off to form the circular arc of diffuser shoulder 6*e*, since the cut area is directly proportional to the second power of the radius.

Figure 8A:
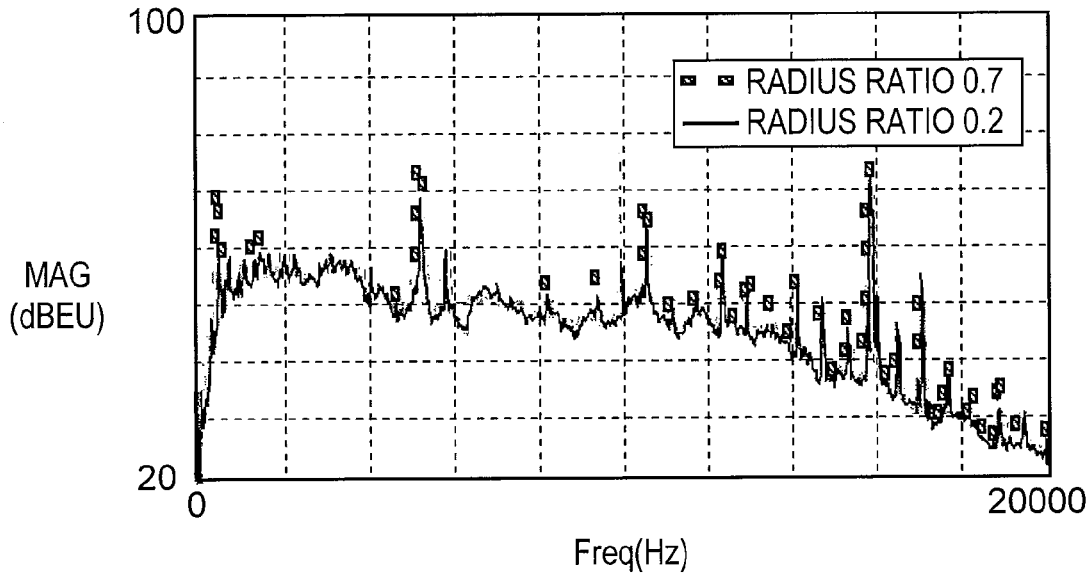
FIG. 8A is a graphic representation of noise waveforms taken from different radius ratios of circular arcs of the diffuser shoulder and the fan case shoulder.
Figure 8B:
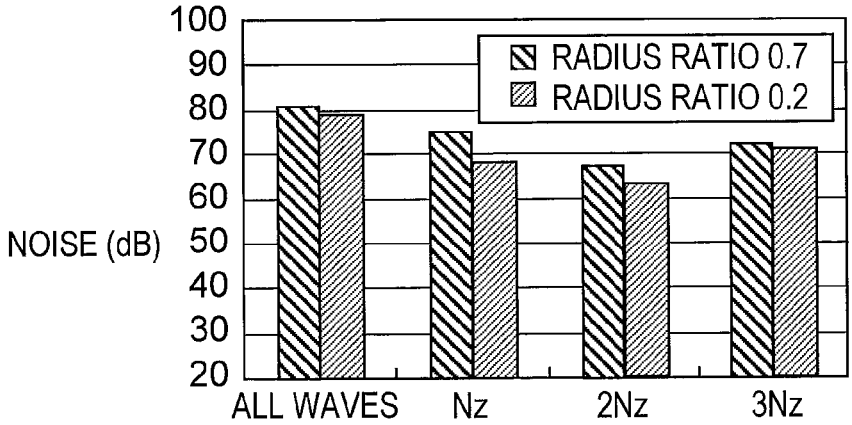
FIG. 8B is a comparison graph of the noise waveforms taken from the different radius ratios of circular arcs of the diffuser shoulder and the fan case shoulder.

FIG. 8A is a graphic representation of noise waveforms taken from different radius ratios of circular arc of diffuser shoulder 6*e* and fan case shoulder 8*b*. That is, FIG. 8A shows a result of frequency analysis on the noise. FIG. 8B is a comparison graph of the noise waveforms taken from the different radius ratios of circular arc of diffuser shoulder 6*e* and fan case shoulder 8*b*. That is, FIG. 8B is a graph showing comparison result of sound intensities of the fundamental wave Nz, the second harmonic 2 Nz and the third harmonic 3 Nz in FIG. 8A.

The result of comparison shown in FIG. 8A and FIG. 8B are the waveforms of the noise obtained by experiment on samples having radius ratios of 0.7 and 0.2. As shown in FIG. 8A and FIG. 8B, there is a substantial reduction of the Nz sound that becomes a problem as the noise of the electric blower when the radius ratio is set to 0.2. The same effect of noise reduction is also apparent on the noise in the frequencies of 2 Nz and 3 Nz, or the harmonics of the Nz sound, as shown in these figures.

Furthermore, a result of comparison of the efficiency of electric blower 50 indicates that there is scarcely any tendency of changes in the characteristic curves of efficiency and the like according to the experiment conducted with input to the electric motor kept unchanged.

In addition, electric blower 50 of the present invention can improve cleaning performance of a vacuum cleaner when installed, since it is capable of reducing noise while ensuring a strong force of suctioning at the same time.

What has been described here is an example of structure having the diffuser shoulder and fan case shoulder 8*b* of circular arc shape. However, this example is to be considered as not restrictive, and they can be of any other shapes as long as the airflow path can be secured.

As has been illustrated, the electric blower of the present invention comprises a stator, a rotor supported inside the stator in a rotatable manner around an output shaft, a bracket supporting the stator, a rotary fan mounted to one end of the output shaft in an axial direction thereof, an air guide disposed between the bracket and the rotary fan, and a fan case having an air inlet opening at a center of the fan case and covering the air guide and the rotary fan. The air guide comprises a partition plate disposed between the bracket and the rotary fan, a diffuser provided with a plurality of diffuser vanes and disposed around the outer periphery of the rotary fan, a partition-plate sloped portion having a slope and in contact with a bottom surface of the diffuser, and a guide vane formed on the back side of the diffuser through the partition plate. The fan case comprises a fan-facing portion extending radially and facing the rotary fan, a fan case shoulder curved into an arc shape from an outermost part of the fan-facing portion toward the axial direction, and a cylindrical portion extending cylindrically in the axial direction from the shoulder. The diffuser vane has a diffuser shoulder cut into a circular arc shape at one corner adjacent to an exit side in an airflow path of the diffuser, so that a circular arc radius of the fan case shoulder becomes one-half of or smaller than one-half of a circular arc radius of the diffuser shoulder in their meridian plane.

It becomes possible by virtue of the above structure to achieve a sufficient level of noise reduction without making the diffuser shoulder into the shape of right angle. According to the present invention, the electric blower can reduce noise of the blower without decreasing an output thereof, thereby achieving noise reduction of an apparatus equipped with the blower.

Third Exemplary Embodiment

Any of electric blowers 50 discussed in the above embodiments can be mounted to a vacuum cleaner. Description is provided of an example of vacuum cleaner equipped with electric blower 50 in one of the first embodiment and the second embodiment.

Figure 9:
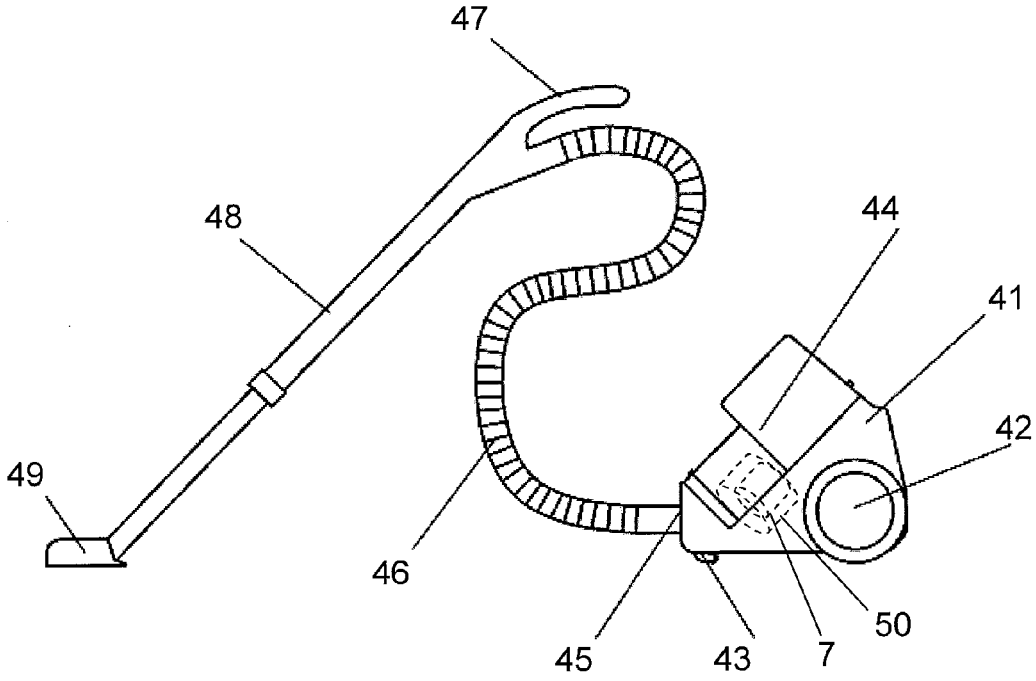
FIG. 9 is an external view of a vacuum cleaner according to a third exemplary embodiment of the present invention.

FIG. 9 is an external view of the vacuum cleaner according to the third exemplary embodiment of this invention.

As shown in FIG. 9, main cleaner unit 41 is provided with wheel 42 and caster 43 mounted to its outer body. This is to allow main cleaner unit 41 to move freely on a floor surface.

Main cleaner unit 41 also has suction port 45 formed in a lower portion thereof, wherein suction hose 46 and extension pipe 48 provided with handle 47 are connected one after another. Floor nozzle 49 is attached to the end of extension pipe 48.

Main cleaner unit 41 has electric blower 50 of the above embodiment built in it, and electric blower 50 includes electric motor 7. Dust collection case 44 is disposed inside main cleaner unit 41 in a removable manner. Dust collection case 44 collects air that contains dust. This structure can reduce noise without increasing the size and weight of the main body. The vacuum cleaner can ensure a strong suctioning force and improve the cleaning performance.

INDUSTRIAL APPLICABILITY

As discussed above, it becomes possible to achieve low noise and high power of the electric blower and the vacuum cleaner equipped with the same according to the present invention. This invention is therefore useful for cleaners and the like apparatuses of domestic use and for industrial purposes.

The invention claimed is:

1. An electric blower comprising a stator, a rotor supported inside the stator in a rotatable manner around an output shaft, a bracket supporting the stator, a rotary fan mounted to one end of the output shaft in an axial direction thereof, an air guide disposed between the bracket and the rotary fan, and a fan case having an air inlet opening at a center of the fan case and covering the air guide and the rotary fan, wherein:

the air guide comprises a partition plate disposed between the bracket and the rotary fan, a diffuser provided with a plurality of diffuser vanes and disposed around outer periphery of the rotary fan, wherein a closed flow path formed between the diffuser vanes, a diffuser shoulder comprising a rounded corner of a circular arc shape formed along an edge of the diffuser exit side of the closed flow path of the diffuser, a partition-plate sloped portion having a slope and in contact with a bottom surface of the diffuser, and a guide vane formed on the back side of the diffuser through the partition plate;

the fan case comprises a fan-facing portion extending radially and facing the rotary fan, a fan case shoulder curved into an arc shape from an outermost part of the fan-facing portion toward the axial direction, and a cylindrical portion extending cylindrically in the axial direction from the shoulder; and the circular arc of the fan case shoulder has an area in the meridian plane less than or equal to one fourth of an area in the same meridian plane of the circular arc of the diffuser shoulder.

2. A vacuum cleaner equipped with the electric blower as defined in claim 1.

3. The electric blower as defined in claim 2, wherein the rotary fan comprises a side plate, a main shroud and a plurality of fan blades fixed between the side plate and the main shroud, the rotary fan has an opening formed in a center part of the side plate for suctioning an air, and a circular arc radius of the fan case shoulder is one-half of or smaller than one-half of a circular arc radius of the diffuser shoulder in respective meridian planes of the fan case shoulder and the diffuser shoulder.

4. A vacuum cleaner equipped with the electric blower as defined in the claim 3.

* * * * *